United States Patent [19]

Croat

[11] Patent Number: 5,056,585

[45] Date of Patent: Oct. 15, 1991

[54] HIGH ENERGY PRODUCT RARE EARTH-IRON MAGNET ALLOYS

[75] Inventor: John J. Croat, Sterling Heights, Mich.

[73] Assignees: General Motors Corporation, Detroit, Mich.; General Motors Corporation, Detroit, Mich.

[21] Appl. No.: 764,720

[22] Filed: Aug. 12, 1985

Related U.S. Application Data

[60] Division of Ser. No. 508,266, Jun. 24, 1983, abandoned, which is a continuation-in-part of Ser. No. 414,936, Sep. 3, 1982.

[51] Int. Cl.[5] ..... B22D 11/06

[52] U.S. Cl. ..... 164/463; 164/462

[58] Field of Search ..... 164/462, 463

[56] References Cited

U.S. PATENT DOCUMENTS 4,402,770 9/1983 Koon ..... 75/123 E X 4,409,043 10/1983 Koon ..... 420/435

FOREIGN PATENT DOCUMENTS 56-116844 9/1981 Japan ..... 148/403

OTHER PUBLICATIONS

Croat, "Preparation And Coercive Force Of Melt-Spun Pr-Fe Alloys," Appl. Phys. Lett. 37 (12), Dec. 15, 1980, pp. 1096-1098.

Kabacoff et al., (Kabacoff), "Thermal And Magnetic Properties Of Amorphous $Pr_x(Fe_{0.8}B_{0.2})_{1-x}$," J. Appl. Phys. 53(3), Mar. 1982, pp. 2255-2257.

*Primary Examiner*—Kuang Y. Lin

*Attorney, Agent, or Firm*—George A. Grove; George A. Grove

[57] ABSTRACT

Magnetically hard compositions having high values of coercivity, remanence and energy product contain rare earth elements, transition metal elements and boron in suitable proportions. The preferred rare earth elements are neodymium and praseodymium, and the preferred transition metal element is iron. The magnetic alloys have characteristic very finely crystalline microstructures.

6 Claims, 25 Drawing Sheets

HIGH ENERGY PRODUCT RARE EARTH-IRON MAGNET ALLOYS

This is a division of application Ser. No. 508,266 filed on June 24, 1983, now abandoned, which is a continuation-in-part of U.S. Ser. No. 414,936, filed in the United States on Sept. 3, 1982, which is a continuation-in-part of USSN 414,936, filed in the United States on Sept. 3, 1982.

The invention relates to permanent magnet alloys of rare earth elements, transition metal elements and boron.

BACKGROUND

U.S. Ser. No. 274,070, entitled "High Coercivity Rare Earth-Iron Magnets", assigned to the assignee hereof, discloses novel magnetically hard compositions and the method of making them. More specifically, it relates to alloying mixtures of one or more transition metals and one or more rare earth elements. The alloys are quenched from a molten state at a carefully controlled rate such that they solidify with extremely fine grained crystalline microstructures as determinable by X-ray diffraction of powdered samples. The alloys have room temperature intrinsic magnetic coercivities after saturation magnetization of at least about 1,000 Oersteds. The preferred transition metal for the magnet alloys is iron, and the preferred rare earth elements are praseodymium and neodymium. Among the reasons why these constituents are preferred are their relative abundance in nature, low cost and inherently higher magnetic moments.

I have now discovered a new family of magnets that have markedly improved properties compared with my earlier discovery. It is an object of the subject invention to provide novel magnetically hard compositions based on rare earth elements and iron with extremely fine grained crystal structures having very high magnetic remanence and energy products and Curie temperatures well above room temperature. Another object is to create a stable, finely crystalline, magnetically hard, rare earth element and iron containing phase in melted and rapidly quenched alloys so that strong permanent magnets can be reliably and economically produced.

A more specific object is to make magnetically hard alloys by melting and rapidly quenching mixtures of one or more rare earth elements, one or more transition metal elements and the element boron. Such alloys exhibit higher intrinsic coercivities and energy products than boron-free alloys. A more specific object is to make such high strength magnet alloys from iron, boron and lower atomic weight rare earth elements, particularly neodymium and praseodymium. Another object is to make these magnetically hard alloys by melt spinning or a comparable rapid solidification process.

Yet another object of the invention is to provide a novel, stable, rare earth-iron-boron, intermetallic, very finely crystalline, magnetic phase. A more particular object is to control the formation of such phase so that the crystallite size appears to be commensurate with optimum single magnetic domain size either by a direct quench or overquench and subsequent heat treatment. Another particular object is to either directly or indirectly create such optimum domain size crystallites in a melt spun or otherwise rapidly quenched RE-Fe-B alloy, particularly a neodymium or praseodymium-iron-boron alloy.

It is a further object to provide a suitable amount of boron in a mixture of low atomic weight rare earth elements and iron to promote the formation of a stable, very finely crystalline, intermetallic phase having high magnetic remanence and energy product. Another particular object is to provide the constituent metallic elements in suitable proportions to form these new intermetallic phases and then process the alloys to optimize the resultant hard magnetic properties.

BRIEF SUMMARY

In accordance with a preferred practice of the invention, an alloy with hard magnetic properties is formed having the basic formula $RE_{1-x}(TM_{1-y}B_y)_x$.

In this formula, RE represents one or more rare earth elements. The rare earth elements include scandium and yttrium in Group IIIA of the periodic table and the elements from atomic number 57 (lanthanum) through 71 (lutetium). The preferred rare earth elements are the lower atomic weight members of the lanthanide series, particularly neodymium and praseodymium. However, substantial amounts of certain other rare earth elements may be mixed with these preferred rare earth elements without destroying or substantially degrading the permanent magnetic properties.

TM herein is used to symbolize a transition metal taken from the group consisting of iron or iron mixed with cobalt, or iron and small amounts of such other metals as nickel, chromium or manganese. Iron is preferred for its relatively high magnetic remanence and low cost. A substantial amount may be mixed with iron without adverse effect on the magnetic properties. Nickel, chromium and manganese are also a transition metals. However, their inclusion in amounts greater than 10 percent have generally been found to have a deleterious effect on permanent magnetic properties of Nd-Fe-B alloys.

The most preferred alloys contain the rare earth elements Nd and/or Pr and the transition metal element, Fe. The superior properties of these light rare earth-iron combinations are due, at least in part, to ferromagnetic coupling between the light rare earth elements and Fe. That is, in optimum alloys the orbital magnetic moments ($\vec{L}$) of the rare earths align in the same parallel direction as the spin moments of the iron ($\vec{S}$) so that the total moment ($\vec{J}$) equals $\vec{L}+\vec{S}$. For the heavy rare earth elements such as Er, Tb and Ho, the magnetic coupling is antiferromagnetic and the orbital magnetic moments of the rare earths are antiparallel to the iron spin moment so that the total moment $\vec{J}=\vec{L}-\vec{S}$. The total magnetic moment of the ferromagnetically coupled light rare earth-iron alloys is, therefore, greater than that of antiferromagnetically coupled heavy rare earth-iron alloys. The rare earth element, samarium, may couple ferro or antiferromagnetically with iron, behaving therefore as both a light and a heavy rare earth element within the context of this invention.

B is the atomic symbol for the element boron. X is the combined atomic fraction of transition metal and boron present in a said composition and generally $0.5 \lesssim x \lesssim 0.9$, and preferably $0.8 \lesssim x \lesssim 0.9$. Y is the atomic fraction boron present in the composition based on the amount of boron and transition metal present. An acceptable range for y is $0.005 \lesssim y \lesssim 0.10$, the preferred range being $0.5 \lesssim y \lesssim 0.7$. B should not be present as more than about 10 atomic percent of the total composition, and preferably less than 7 percent. The incorporation of only a small amount of boron in alloys having suitable finely crystalline microstructures was found to substantially increase the coercivity of RE-Fe alloys at temperatures up to 200° C. or greater, particularly those alloys having high iron concentrations. In fact, the alloy $Nd_{0.2}(Fe_{0.95}B_{0.05})_{0.8}$ exhibited an intrinsic magnetic room temperature coercivity exceeding about 20 kilo-Oersteds, substantially comparable to the hard magnetic characteristics of much more expensive $SmCo_5$ magnets. The boron inclusion also substantially improved the energy product of the alloy and increased its Curie temperature.

Permanent magnet alloys in accordance with the invention were made by mixing suitable weight portions of elemental forms of the rare earths, transition metals and boron. The mixtures were arc melted to form alloy ingots. The alloy was in turn remelted in a quartz crucible and expressed through a small nozzle onto a rotating chill surface. This produced thin ribbons of alloy. The process is generally referred to in the art as "melt spinning" and is also described in U.S. Ser. No. 274,040. In melt spinning, the quench rate of the melt spun material can be varied by changing the linear speed of the quench surface. By selection of suitable speed ranges I obtained products that exhibited high intrinsic magnetic coercivities and remanence. Furthermore, I found that products with such properties could be produced either as directly quenched from the melt, or as overquenched and annealed as will be described hereinafter. In each case where good magnetic properties were obtained, the magnetic material comprised very small crystallites (about 20 to 400 nanometers average diameter) apparently sized near the optimum single magnetic domain size or smaller. The fairly uniform shape of the crystallites as exhibited by scanning electron microscopy suggests a crystal structure that is fairly uniform in all directions such as a tetragonal or cubic structure. Alloys of such structure constitute a heretofore unknown magnetic phase.

The inclusion of boron in suitable amounts to mixtures of rare earth elements and iron was found to promote the formation of a stable, hard magnetic phase over a fairly broad range of quench rates. The magnetic remanence and energy product of all melt-spun, magnetically hard, boron-containing, RE-iron alloys were improved. The Curie temperatures of the alloys were substantially elevated. My invention will be better understood in view of the following detailed description.

DETAILED DESCRIPTION

Figure 11:
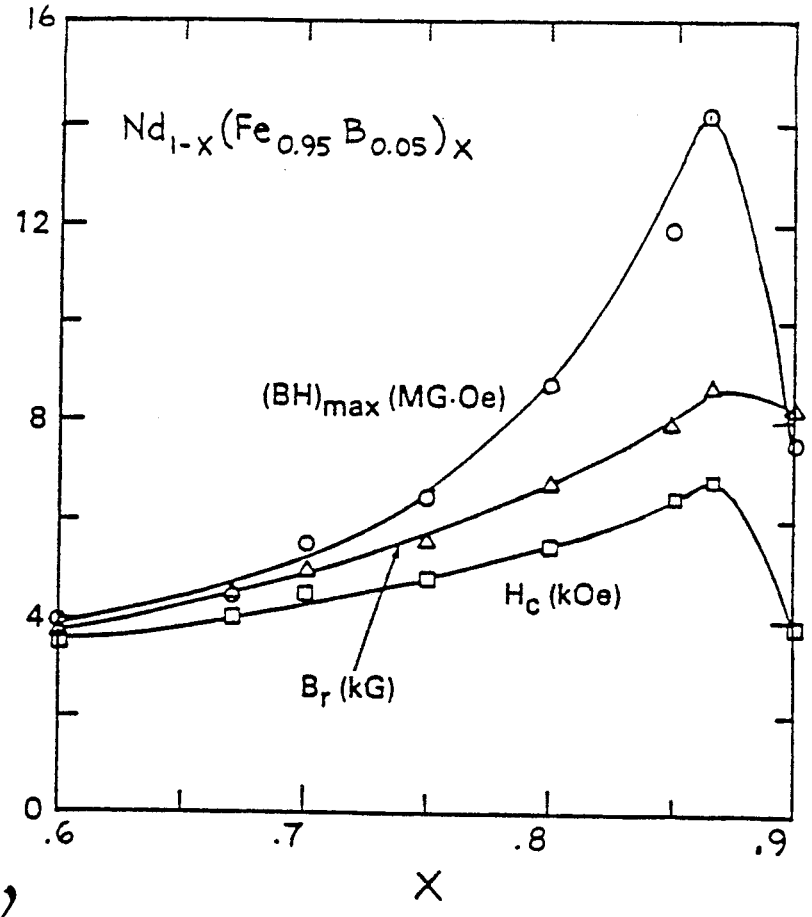
Figure 12:
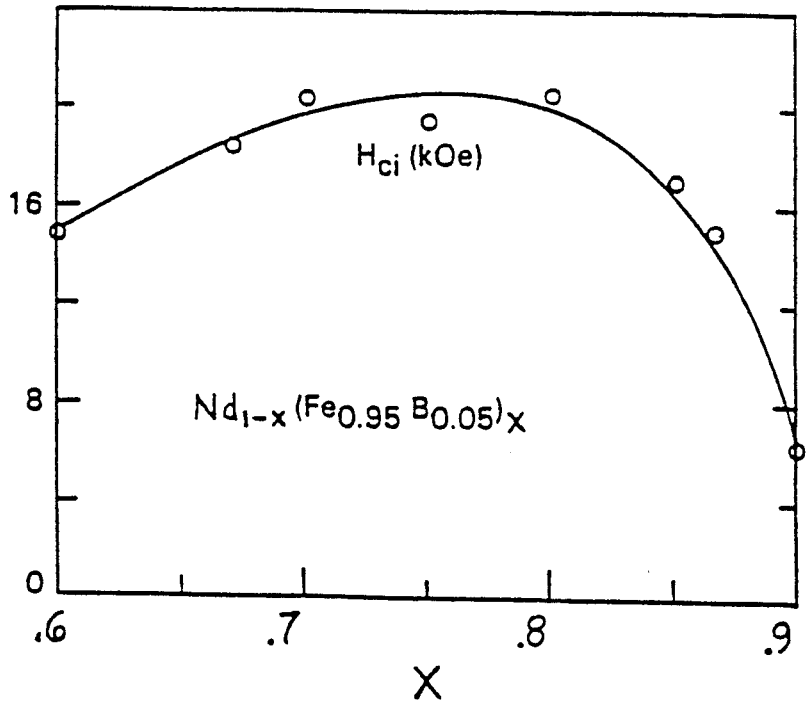

FIG. 11 s a plot of energy product, magnetic remanence and magnetic coercivity of $Nd_{1-x}(Fe_{0.95}B_{0.05})_x$ as a function of neodymium content, and FIG. 12 shows intrinsic coercivities of $Nd_{1-x}(Fe_{0.95}B_{0.05})_x$ alloy as a function of neodymium content.

FIG. 13 is a scanning electron micrograph of the fracture surface of a melt spun ribbon of $Nd_{0.135}(Fe_{0.946}B_{0.054})_{0.865}$ alloy as quenched, the micrographs being taken at the free surface, the interior and the quench surface of the ribbon.

FIG. 14 shows demagnetization curves (M versus H and B versus H) for the melt spun $Nd_{0.135}(Fe_{0.946}B_{0.054})_{0.865}$ alloy of FIG. 13.

FIG. 15 shows demagnetization curves for melt spun $Nd_{1-x}(Fe_{0.95}B_{0.05})_x$ alloys.

FIG. 16 shows demagnetization curves for melt spun $Nd_{0.33}(Fe_{0.95}B_{0.05})_{0.67}$ at several different temperatures between 295° K and 450° K FIG. 17 shows demagnetization curves of melt spun $Nd_{0.15}(Fe_{0.95}B_{0.05})_{0.85}$ at several different temperatures between 295° K and 450° K.

FIG. 18 plots normalized log values of intrinsic coercivity for three neodymium-iron-boron alloys as a function of temperature.

FIG. 19 is a plot showing the temperature dependence of magnetic remanence for several neodymium-iron-boron alloys.

FIG. 20 plots the temperature dependence of magnetization for melt spun $Nd_{0.25}(Fe_{1-y}B_y)_{0.75}$ at several different boron additive levels.

FIG. 21 plots the magnetization of several melt spun $Nd_{1-x}(Fe_{0.95}B_{0.05})_x$ alloys as a function of temperature.

FIG. 22 shows representative X-ray spectra for melt spun $Nd_{0.15}(Fe_{1-y}B_y)_{0.85}$ alloy for values of two theta between about 20 and 65 degrees.

FIG. 23 shows X-ray spectra of melt spun $Nd_{0.25}(Fe_{0.95}B_{0.05})_{0.75}$ taken of material located on the quench surface of a ribbon of the alloy and of a sample of material from the free surface remote from the quench surface.

FIG. 24 shows differential scanning calorimetry tracings for $Nd_{0.25}(Fe_{1-y}B_y)_{0.75}$ alloys taken at a heating rate of 8020 K per minute.

FIG. 25 shows differential scanning calorimetry traces for $Nd_{0.15}(Fe_{0.85})$, $Nd_{0.15}(Fe_{0.95}B_{0.05})_{0.85}$ and $Nd_{0.15}(Fe_{0.91}B_{0.09})_{0.85}$ taken at a heating rate of 80° K per minute for melt-spinning quench speeds of $V_s=30$ and 15 m/s.

FIG. 26 shows typical demagnetization curves for several permanent magnet materials and values of maximum magnetic energy products therefor.

FIG. 27 shows the effect of adding boron to $Nd_{1-x}(Fe_{1-y}B_y)_x$ alloys on Curie temperature.

FIG. 28 is a plot showing the relative coercivities of samples of $Nd_{0.15}(Fe_{0.95}B_{0.05})_{0.85}$ melt spun at quench wheel speeds of 30 and 15 meters per second and thereafter annealed at about 850° K for 30 minutes.

FIG. 29 is a demagnetization curve for $Nd_{0.14}(Fe_{0.95}B_{0.05})_{0.86}$ originally melt spun and quenched at $V_s=30$ m/s and then taken to a maximum anneal temperature of Ta=950° K at a ramp rate of 160° K per minute, held for 0, 5, 10 and 30 minutes.

FIG. 30 is a comparison of the demagnetization curves for $Nd_{0.14}(Fe_{0.95}B_{0.05})_{0.86}$ alloy melt spun and quenched at wheel speeds of $V_s$=27.5 and 30 m/s and annealed at ramp rates of 160 and 40° K per minute.

FIG. 31 is a plot of maximum energy product as a function of the linear speed of the quench surface for $Nd_{0.14}(Fe_{0.95}B_{0.05})_{0.86}$ alloy. The open circles form the curve for the alloy as quenched, while the open squares, triangles and closed circles represent material melt spun at the indicated $V_s$ value and later annealed at a ramp rate of 160° K per minute to maximum temperatures of 1000, 975 and 950° K.

FIG. 32 is a demagnetization curve for $Nd_{0.135}(Fe_{0.935}B_{0.065})_{0.865}$ alloy at several linear quench surface speeds also indicating maximum energy product for a particular $V_s$.

FIG. 33 shows X-ray powder diffraction patterns of $Nd_{0.135}(Fe_{0.935}B_{0.065})_{0.865}$ melt spun and quenched at several different quench surface speeds ($V_s$).

FIG. 34 shows differential scanning calorimetry tracings for $Nd_{0.135}(Fe_{0.946}B_{0.054})_{0.865}$ alloy taken at a heating rate of 160° K per minute for alloys quenched at $V_s$=19, 20.5 and 35 m/s.

FIG. 35 is a demagnetization curve for $Nd_{0.135}(Fe_{0.946}B_{0.054})_{0.865}$ alloy originally quenched at a linear quench surface rate of $V_s$=20.5 m/s and then annealed at heating and cooling ramp rates of 160° K per minute to maximum temperatures of 950, 975 and 1000° K indicating the maximum energy product for each.

FIG. 36 is a curve like that of FIG. 35 except that $V_s$=35 m/s.

FIG. 37 is a panel of three scanning electron micrographs taken along the fracture surface of a melt spun ribbon of $Nd_{0.14}(Fe_{0.95}B_{0.05})_{0.86}$ alloy where the linear speed of the quench surface $V_s$=30 m/s. The SEM's are representative of the microstructure near the free surface, the center and the quench surface of the ribbon.

FIG. 38 is a panel of three scanning electron micrographs taken along the fracture surface of a melt spun ribbon of $Nd_{0.14}(Fe_{0.95}B_{0.05})_{0.86}$ alloy originally quenched at a linear quench surface speed of $V_s$=30 m/s and then annealed at a maximum temperature of 950° K at a heating and cooling ramp rate of 160° K per minute, the SEM's being taken near the free surface, the center, and the quench surface of the ribbon.

FIG. 39 is a demagnetization curve for $Nd_{0.135}(Fe_{0.946}B_{0.054})_{0.865}$ alloy originally quenched at linear quench surface rates of $V_s$=29, 20.5 and 35 m/s, annealed at 950° K maximum at a heating and cooling ramp rate of 160° K per minute.

FIG. 40 is a demagnetization curve for $Pr_{0.135}(Fe_{0.935}B_{0.065})_{0.86}$ alloy melt spun at a linear quench surface speed of $V_s$=30 m/s and then annealed at a ramp rate of 160° K per minute to maximum temperatures of 900, 925 and 975° K.

FIG. 41 is a plot of $RE_{0.135}(Fe_{0.935}B_{0.065})_{0.865}$ melt spun and quenched at a linear quench surface speed of $V_s$=30 and then annealed to a maximum temperature of 950° K at a heating and cooling ramp rate of 160° K per minute where RE is praseodymium, neodymium, samarium, lanthanum, cerium, terbium and dysprosium.

FIG. 42 is a demagnetization curve for $(Nd_{0.8}RE_{0.2})_{0.135}(Fe_{0.935}B_{0.065})_{0.865}$ alloy melt spun and quenched at a linear quench surface speed $V_s$=30 m/s and then annealed at a heating and cooling ramp rate of 160° K per minute to a maximum temperature of 950° K.

FIG. 43 is a demagnetization curve for $Nd_{0.135}(TM_{0.935}B_{0.065})_{0.865}$ alloys originally melt spun at a quench speed of $V_s$=30 m/s annealed at a ramp rate of 160° K per minute to a maximum temperature of 950° K, where TM is iron, cobalt and nickel.

FIG. 44 shows demagnetization curves for $Nd_{0.135}(Fe_{0.841}TM_{0.094}B_{0.065})_{0.865}$ alloy originally melt spun at a quench surface speed of $V_s$=30 m/s annealed at a heating and cooling ramp rate of 160° K per minute to a maximum temperature of 950° K, where TM is cobalt, nickel, chromium, manganese and copper.

FIG. 45 is a demagnetization curve for $Nd_{0.135}(Fe_{0.784}TM_{0.187}B_{0.065})_{0.865}$ alloys originally melt spun at a quench surface rate of $V_s$=30 m/s and then annealed at a heating and cooling ramp rate of 160° K per minute to a maximum temperature of 950° K, where TM is cobalt, nickel, chromium and manganese.

This invention relates to making improved magnetically hard rare earth-transition metal compositions by incorporating small amounts of the element boron and quenching molten mixtures of the constituents at a rate between that which yields an amorphous magnetically soft material or a magnetically soft crystalline material.

Herein, H refers to the strength of an applied magnetic field; $H_{ci}$ is the intrinsic coercive force or reverse field required to bring a magnetized sample having magnetization M back to zero magnetization; M is the magnetization of a sample in electromagnetic units; $M_s$ is the saturation magnetization or the maximum magnetization that can be induced in a sample by an applied magnetic field; B is the magnetic induction or magnetic flux density of a sample where $B=H+4\pi M$ (emu), where B, M and H are in units of Gauss or Oersteds; $B_r$ is the remanent magnetic induction; BH is the energy product; and T is temperature in degrees Kelvin unless otherwise indicated. The terms "hard magnet" and "magnetically hard alloy" herein refer to compositions having intrinsic coercivities of at least about 1,000 Oersteds.

Melt Spinning

Melt spinning is a well known process which has been used to make "metglasses" from high alloy steels. As it relates to this invention, melt spinning entails mixing suitable weight portions of the constituent elements and melting them together to form an alloy of a desired composition. Arc melting is a preferred technique for experimental purposes because it prevents any contamination of the alloys from the heating vessel.

In the following examples, alloy ingots were broken into chunks small enough to fit inside a spin melting tube (crucible or tundish) made of quartz. Ceramic, or other suitable refractory materials could be used.. Each tube had a small orifice in its bottom through which an alloy could be ejected. The top of the tube was sealed and provided with means for containing pressurized gas in the tube above a molten alloy. A heating coil was disposed around the portion of the tube containing the alloy to be melt spun. When the coil was activated, the chunks of alloy within the tube melted and formed a fluid mass.

An inert gas is introduced into the space above the molten alloy at a constant positive pressure to eject it through the small orifice at a constant rate. The orifice was located only a short distance from a chill surface on which the molten metal was rapidly cooled and solidified into ribbon form. The surface was the outer perimeter of a rotating copper disc plated with chromium although other chill surfaces and materials such as molybdenum having high thermal conductivity may also be acceptable.

The disc was rotated at a constant speed so that the relative velocity between the ejected alloy and the chill surface was substantially constant However, the rate at which a quench surface moves may be varied throughout a run to compensate for such factors as the heating of the quench surface, varied alloy melt temperature or the creation of a desired microstructure in the ribbon.

Herein, the disc speed ($V_s$) is the speed in meters per second of a point on the chill surface of the melt spinner's quench disc as it rotates at a constant rotational velocity. Because the chill disc is much more massive than the alloy ribbon, it acts as an infinitely thick heat sink for the metal that solidifies on it. The disc may be cooled by any suitable means to prevent heat build-up during long runs. The terms "melt-spinning" or "melt-spun" as used herein refer to the process described above as well as any like process which achieves a like result.

The principal limiting factor for the rate of chill of a ribbon of alloy on the relatively cooler disc surface is its thickness. If the ribbon is too thick, the metal most remote from the chill surface will cool too slowly and crystallize in a magnetically soft state. If the alloy cools very quickly, the ribbon will have a microstructure that is somewhere between almost completely amorphous and very, very finely crystalline.

Overquenched melt spin ribbons have low intrinsic magnetic coercivity, generally less than a few hundred Oersteds. If they are amorphous, i.e. completely glassy, they cannot be later annealed to achieve magnetic properties comparable to an alloy directly quenched at the optimum rate. However, if an alloy is cooled at a slightly slower rate than that which produces a glass, an incipient microcrystalline structure seems to develop. The slightly overquenched alloy has low coercivity as formed but has the capacity to develop a near optimum microcrystalline hard magnetic phase. That is, a controlled rapid anneal of a partially overquenched alloy can promote the development of a finely crystalline hard magnetic phase. This phase appears to be the same as that present in the best directly quenched, boron-containing alloy ribbon.

In all of the following examples, a melt spinning apparatus of the type described above was used to make ribbons of the novel magnetic compositions. The quartz tube for Examples 1, 2, 4–9, 12–20 and 23–24 was about 100 mm long and 12.7 mm in diameter. About 4 grams of alloy chunks were added to the tube for each run. The ejection orifice was round and about 500 microns in diameter, and an argon ejection pressure of about 5 psi was used. For the remaining examples, the quartz tube was about 127 mm long and about 25 mm in diameter. About 25–40 grams of alloy chunks were added to the tube for each run. The ejection orifice was round and about 675 microns in diameter. An argon ejection pressure of about 3.0 psi was used. In each case, the orifice was located about $\frac{1}{8}$ to $\frac{1}{4}$ inches from the chill surface of the cooling disc. The disc was initially at room temperature and was not externally cooled. The resultant melt spun ribbons were about 30–50 microns thick and about 1.5 millimeters wide.

While melt spinning is a preferred method of making the subject boron enhanced RE-TM magnet materials, other comparable methods may be employed The critical element of the melt-spinning process is the controlled quenching of the molten alloy to produce the desired very fine crystalline microstructure.

X-ray data supports the hypothesis that the hard magnetic phase is, in fact, very finely crystalline. Scanning electron microscopy results indicate that the optimum average crystallite size is between about 20 and 400 nanometers. I believe that such small crystallite size is nearly commensurate with optimum single domain size for the subject RE-Fe-B alloys.

Composition

The magnetic compositions of this invention are formed from molten homogeneous mixtures of certain rare earth elements, transition metal elements and boron.

The rare earth elements include scandium and yttrium in group IIIA of the period table as well as the lanthanide series elements from atomic No. 57 (lanthanum) through atomic No. 71 (lutetium). In order to achieve the desired high magnetic coercivities for the subject magnet compositions, I believe that the f-orbital of the preferred rare earth constituent elements or alloys should not be empty, full or half full. That is, there should not be zero, seven or fourteen electrons in the f-orbital of the alloyed rare earth constituent.

The preferred rare earth elements for use in this invention are two lower atomic weight members of the lanthanide series, neodymium and praseodymium. These are among the most abundant, least expensive, and have highest magnetic moments of the light rare earths. The elements Nd and Pr also have an inherently high magnetic moments and couple ferromagnetically with iron (total moment, $\vec{J}=\vec{L}+\vec{S}$).

It is usually possible to substitute rare earth elements for one another in the crystal lattice of an alloy. For example, if the atomic radius of a rare earth element is critical to the behavior and micrographic structure of an alloy in which it is mixed with a transition metal, e.g. , the substitution of two different rare earth elements, one with a greater atomic radius and one with a smaller radius, may produce an alloy with like crystallographic structure as the original alloy.

Therefore, it may be possible to substitute other rare earth elements for Pr and Nd in our alloys. However, the heavier rare earth elements such as terbium, holmium, dysprosium, erbium and thulium couple antiferromagnetically with iron. Therefore, these heavy rare earth containing iron alloys would not be expected to produce permanent magnets as strong as Nd-Fe and Pr-Fe alloys.

The elements iron, nickel, cobalt, chromium, copper and manganese are transition metals. In the practice of this invention, iron is a necessary and preferred constituent. Moreover, it is relatively abundant in nature, inexpensive and inherently high in magnetic remanence. Cobalt may be substituted for a portion of this iron. While small amounts of the other transition metals may not interfere severely with the permanent magnetic properties of the subject alloys, they have not been found to augment the permanent magnetic properties either.

Boron was used in elemental form in all cases as were the rare earth and transition metal elements. However, alloyed forms of boron and the other elements may be equally suited. Small amounts of other elements may be present so long as they do not significantly deteriorate the magnetic properties of the compositions.

The relative amounts of RE, TM and B alloyed together are expressed herein in terms of atomic fractions or percents. A distinction is made herein between atomic fractions and atomic weight fractions. For example, one atomic weight unit of the composition having the atomic fraction formula $Nd_{0.4}(Fe_{0.95}B_{0.05})_{0.6}$ would comprise by weight:

| | |
|---|---|
| 0.4 × atomic wt. Nd = 0.4 × 144.24 = | 57.696 g Nd |
| 0.6 × 0.95 × atomic wt. Fe = 0.57 × 55.85 = | 31.835 g Fe |
| 0.6 × 0.05 × atomic wt. B = 0.03 × 10.81 = | 0.324 g B |
| | 89.855 g Total |

which expressed as weight fractions or weight percents of the constituents is:

| wt. fraction | wt. percent |
|---|---|
| Nd 57.696/89.855 = 0.642 | 64.2 |
| Fe 31.835/89.855 = 0.354 | 35.4 |
| B 0.324/89.855 = 0.004 | 0.4 |

The preferred compositional range for the subject hard magnet alloys of this invention is about 10 to 20 atomic percent rare earth elements with the balance being transition metal elements and a small amount (less than about 10 and preferably less than about 7 atomic percent total) boron. Higher percentages of the rare earth elements are possible but may adversely affect the magnetic energy product. Small amounts of other elements may be present so long as they do not materially adversely affect the practice of the invention. My invention will be better understood in view of the following examples.

EXAMPLE 1

Figure 1:
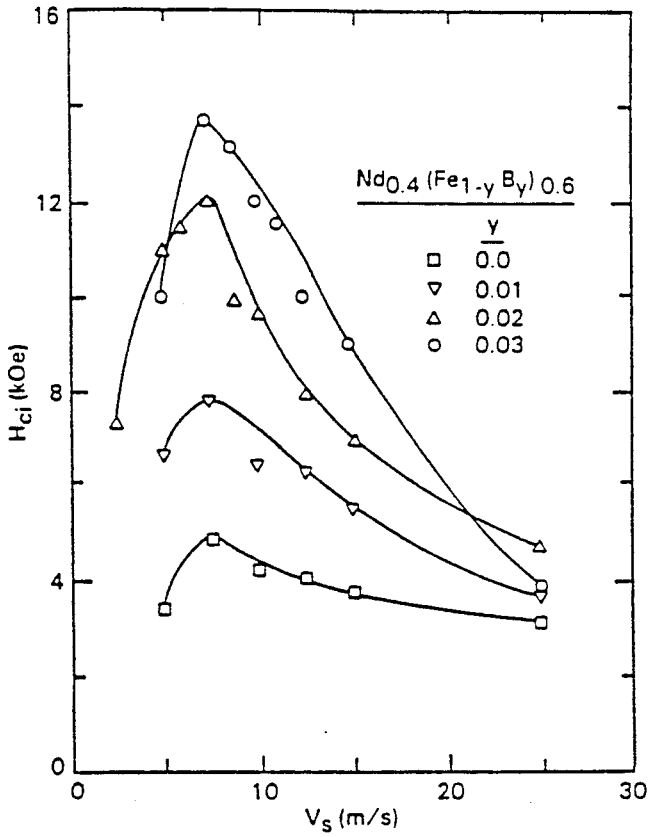
FIG. 1 is a plot of room temperature intrinsic coercivity for magnetized melt spun $Nd_{0.4}(Fe_{1-y}B_y)_{0.6}$ alloys as a function of the linear speed ($V_s$) of the quench surface.

Referring to FIG. 1, alloys of neodymium and iron were made by mixing substantially pure commercially available forms of the elements in suitable weight proportions. The mixtures were arc melted to form alloy ingots. The amount of neodymium was maintained in each alloy at an atomic fraction of 0.4. The iron and boron constituents together made up an atomic fraction of 0.6. The atomic fraction of boron, based on the amount of iron present was varied from 0.01 to 0.03. Each of the alloys was melt spun by the method described above. The quench rate for each alloy was changed by varying the surface velocity of the quench wheel. About four grams of ribbon were made for each sample.

The intrinsic coercivity of each of the alloys for this and the other examples was determined as follows. The alloy ribbon was first pulverized to powder with a roller on a hard surface. Approximately 100 mg of powder was compacted in a standard cylindrical sample holder for the magnetometer. The sample was then magnetized in a pulsed magnetic field of approximately 45 kiloOersteds. This field is not believed to be strong enough to reach magnetic saturation ($M_s$) of the subject alloys but was the strongest available for my work. The intrinsic coercivity measurements were made on a Princeton Applied Research vibrating sample magnetometer with a maximum operating field of 19 kOe. Magnetization values were normalized to the density of the arc melted magnet material.

It can be seen from FIG. 1 that the intrinsic coercivity ($H_{ci}$) is dependent both on quench rate (a function of $V_s$) and boron content The highest overall intrinsic coercivities were achieved for the neodymium iron alloy containing the most boron (3 percent) based on iron. Lesser percentages of boron improved the intrinsic coercivity of the composition over boron-free alloy. The optimum substrate velocity appeared to be about 7.5 meters per second for the small quartz tube with the 500 micron ejection orifice and an ejection pressure of about 5 psi. Intrinsic coercivities were lower for wheel speeds below 5 meters per second and above 15 meters per second.

EXAMPLE 2

Figure 2:
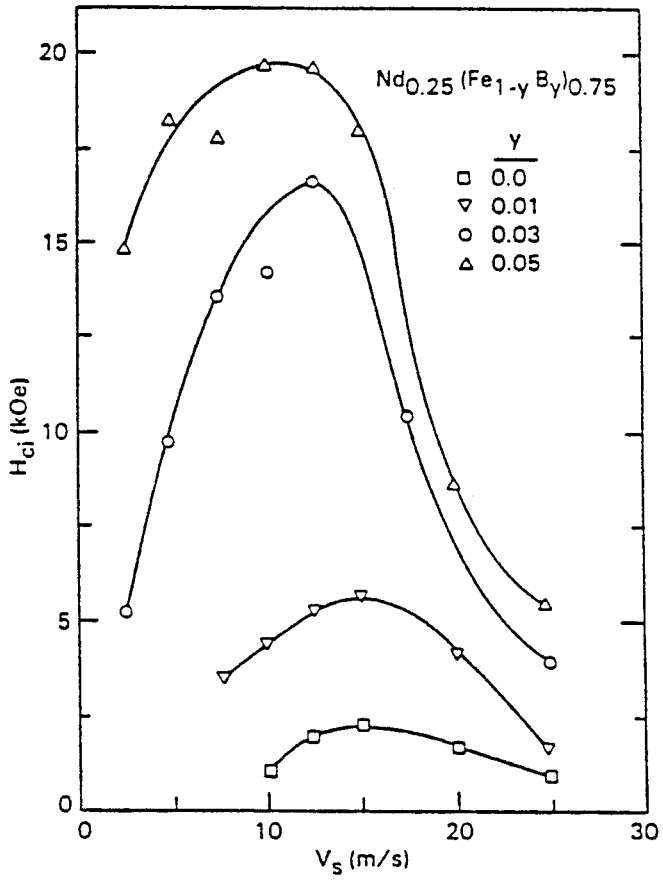
FIG. 2 is a plot of room temperature intrinsic coercivity for magnetized melt spun $Nd_{0.25}(Fe_{1-y}B_y)_{0.75}$ alloys versus the linear speed of the quench surface.

FIG. 2 is a plot of intrinsic magnetic coercivity versus substrate quench speed for alloys of neodymium and iron where neodymium comprises 25 atomic percent of the alloy. The samples were made and tested as in Example 1. Clearly, the inclusion of boron in amounts of three and five atomic percent based on iron content greatly improved the intrinsic room temperature coercivity for these alloys. Without boron, this high iron content alloy does not show very high intrinsic coercivity ( 2.3 kOe maximum). It appears that the inclusion of even a small amount of boron can create high intrinsic magnetic coercivity in certain alloys where it would otherwise not be present. The $Nd_{0.25}(Fe_{0.95}B_{0.05})_{0.75}$ alloy (3.75 atomic percent B) achieved an $H_{ci}$ of 19.7 kOe comparable, e.g., to the intrinsic coercivities of rare earth-cobalt magnets.

EXAMPLE 3

Figure 3:
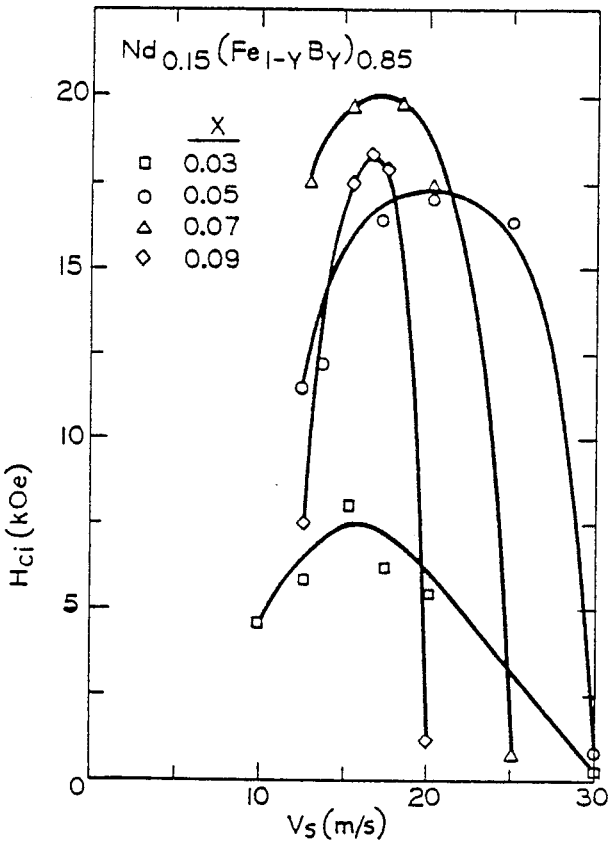
FIG. 3 is a plot of room temperature intrinsic coercivity for magnetized melt spun $Nd_{0\ 15}(Fe_{1-y}B_y)_{0.85}$ alloys as a function of the linear speed ($V_s$) of the quench surface.

FIG. 3 is a plot of intrinsic room temperature coercivity as a function of quench velocity for melt spun ribbons of $Nd_{0.15}(Fe_{1-y}B_y)_{0.85}$ alloy, wherein the fraction of boron with respect to iron was 0.03, 0.05, 0.07 and 0.09. In this example, the alloy was melt spun from the larger quartz tube having an orifice diameter of about 675 microns at an ejection pressure of about 3 psi argon. The maximum coercivity was achieved for y =0.07 at a quench surface velocity of about 17.5 meters per second. The maximum intrinsic coercivity for y =0.05 and 0.09 were both lower than y =0.07. The 0.09 also had a narrower window of quench rates over which the high coercivity magnetic phase formed. The inclusion of 0.03 boron increased the intrinsic coercivity of the alloy as compared to that with no boron, but the highest value of intrinsic coercivity was substantially lower than that for higher boron content alloys.

EXAMPLE 4

Figure 4:
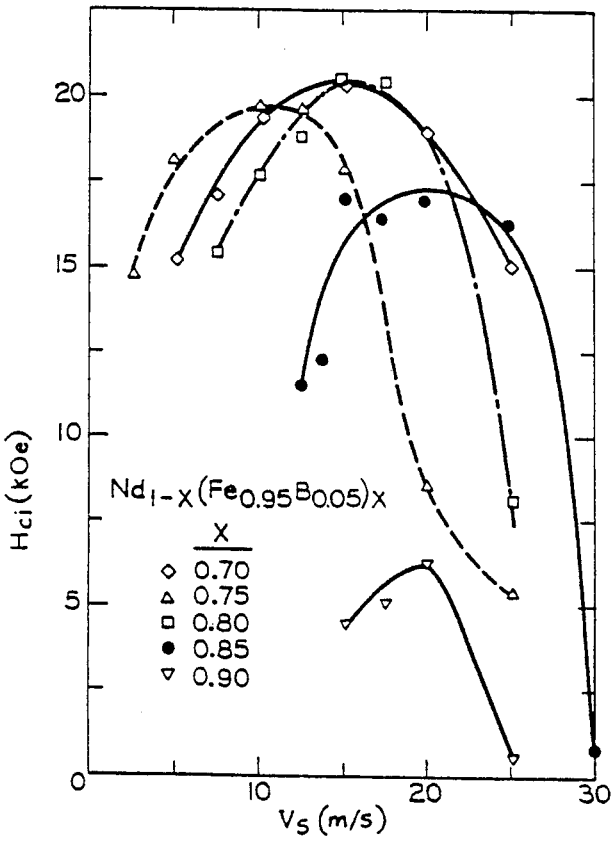
FIG. 4 is a plot of room temperature intrinsic coercivity for magnetized melt spun $Nd_{1-x}(Fe_{0.95}B_{0.05})_x$ alloys as a function of the linear speed of the quench surface.

FIG. 4 is a plot of intrinsic room temperature coercivity as a function of quench velocity for melt spun alloy ribbons of neodymium, iron and boron where the Nd content was varied from 10 to 30 atomic percent and the ratio of iron to boron is held constant at 0.95 to 0.05. The maximum coercivity achieved for the ten atomic weight percent neodymium alloy was only about 6 kiloOersteds. For 15 atomic percent neodymium the maximum intrinsic coercivity achieved was about 17 kiloOersteds. For all other neodymium contents, however, the maximum intrinsic coercivity was at least about 20 kiloOersteds. The optimum quench velocity for these alloys appeared to be in the 10 to 15 meter per second range.

EXAMPLE 5

Figure 5:
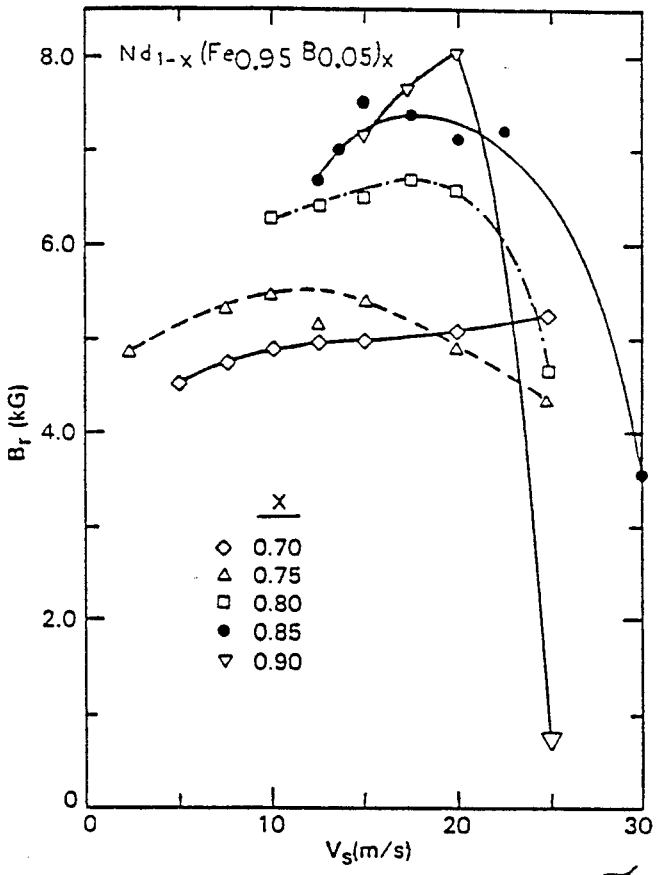
FIG. 5 is a plot of remanent magnetization $B_r$ of melt spun $Nd_{1-x}(Fe_{0/95}B_{0.05})_x$ alloys at room temperature as a function the linear speed of the quench surface.

FIG. 5 is a plot of remanent magnetization ($B_r$) measured at room temperature for melt spun neodymium iron alloys as a function of substrate quench speed. For the high iron content alloys there is clearly a critical substrate quench velocity beyond which the magnetic remanence of the material falls off rapidly. At substrate quench speeds less than 20 meters per second, all of the neodymium alloys showed remanent magnetization values of at least about 4 kiloGauss. Increasing the Fe concentration results in an appreciable increase in remanent magnetization from a maximum of 4.6 kG at X=0.67 to 8.0 kG for X=0.9. A carefully controlled, rapid anneal of overquenched ribbon ($V_s$>20 m/s, e.g.) can be affected as will be described hereinafter to induce coercivity and remanence commensurate with optimally quenched alloy.

EXAMPLE 6

Figure 6:
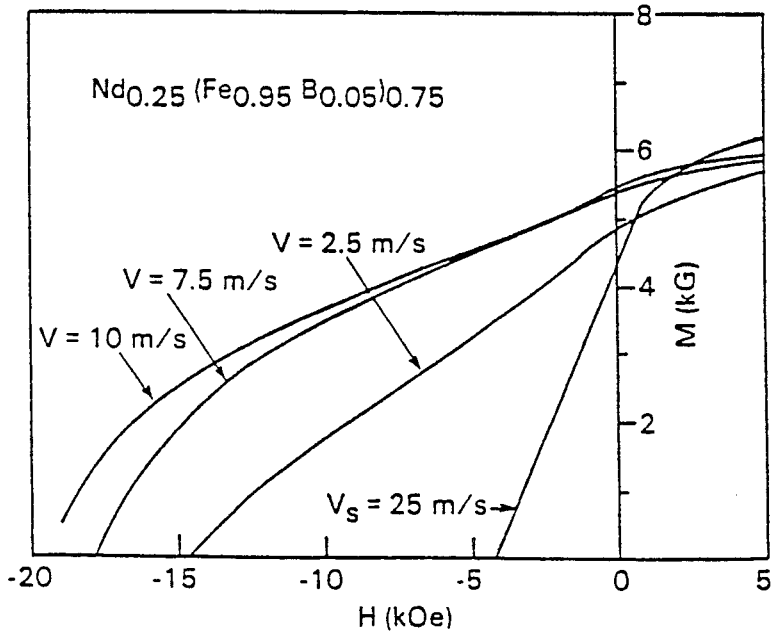
FIG. 6 shows demagnetization curves for melt spun $Nd_{0.25}(Fe_{0.95}B_{0.05})_{0.75}$ as a function of the linear speed of the quench surface.

FIG. 6 is a demagnetization curve for melt spun $Nd_{0.25}(Fe_{0.25}B_{0.05})_{0.75}$ for several different substrate chill velocities. The relatively square hysteresis loop characterized by the relatively flat demagnetization curves in the second quadrant for $V_s$=7.5 and $V_s$=10 meters per second is desirable for many hard magnet applications as it results in higher energy products.

EXAMPLE 7

Figure 7:
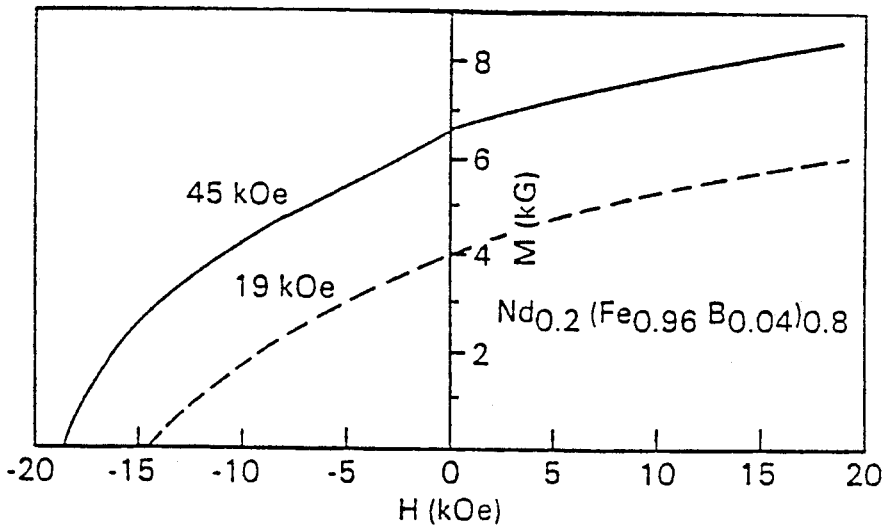
FIG. 7 shows demagnetization curves for melt spun $Nd_{0.2}(Fe_{0.96}B_{0.04})_{0.8}$ alloy for initial magnetizing fields of 19 kOe and 45 kOe.

FIG. 7 shows demagnetization curves for melt spun $Nd_{0.25}(Fe_{0.95}B_{0.05})_{0.75}$ alloy as a function of the initial magnetizing field. The curve is substantially lower for the 19 kiloOersted magnetizing field than the 45 kiloOersted field. As noted in Example 1, I believe that higher remanent magnetization and $H_{ci}$ could be achieved for the subject RE-Fe-B compositions given a stronger magnetizing field strong enough to induce magnetic saturation.

EXAMPLE 8

Figure 8:
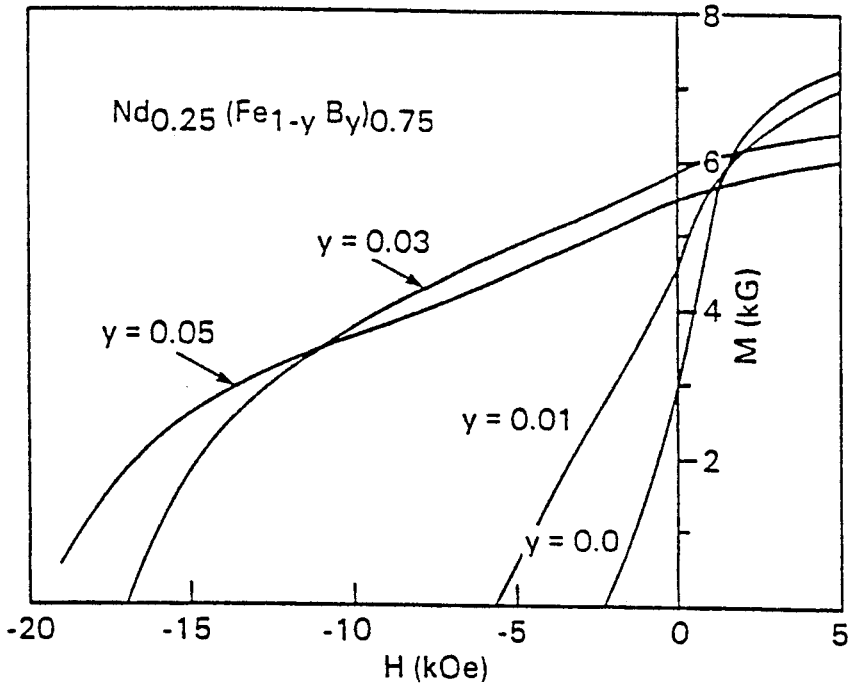
FIG. 8 shows demagnetization curves for melt spun $Nd_{0.25}(Fe_{1-y}B_y)_{0.75}$ alloys.

FIG. 8 shows demagnetization curves for melt-spun 25 atomic percent neodymium iron alloys. The addition of 0.03 and 0.05 atomic fractions boron (based on iron content) served to substantially flatten and extend the demagnetization curves for this alloy indicating higher energy products. Higher boron levels than those shown in FIG. 7, e.g., y=0.07, result in small additional increases in coercivity but remanent magnetization drops, resulting in lowered energy product.

Generally, not much benefit in intrinsic coercivity is gained and a loss of energy product may occur by adding too much boron (based on the total composition) to a melt-spun rare earth-iron alloys. Excess boron also seems to narrow the window of quench rates over which the desired magnetic phase forms directly (See FIG. 3, e.g.). Experimental evidence indicates that a concentration of boron above about 5-6 total atomic percent exceeds the boron concentration of the subject equilibrium magnetic RE-Fe-B intermetallic phase upon which the hard magnetic properties of these materials are based. While excess boron will not destroy the magnetic phase at concentrations up to and even exceeding 10 atomic percent, boron concentrations over about 6 atomic percent do dilute the magnetic properties of the alloys. The inclusion of boron in an amount of about 5-6 percent or less, however, stabilizes the formation of a crystalline intermetallic magnetic phase which forms into a very finely crystalline, magnetically hard microstructure during the quench. Excess boron, above 5-6 atomic percent, appears to promote the formation of magnetically soft Fe-B glasses.

EXAMPLE 9

Figure 9:
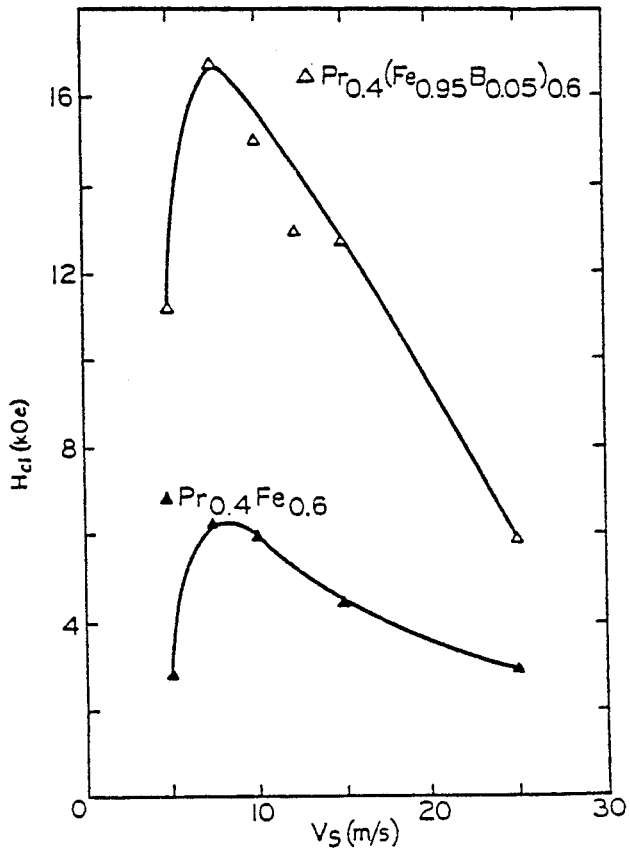
FIG. 9 is a plot of room temperature intrinsic coercivity for magnetized $Pr_{0.4}Fe_{0.6}$ and $Pr_{0.4}(Fe_{0.95}B_{0.05})_{0.6}$ alloys as a function of the linear speed of the quench surface.

FIG. 9 shows the intrinsic room temperature coercivity for $Pr_{0.4}Fe_{0.6}$ and $Pr_{0.4}(Fe_{0.95}B_{0.05})_{0.6}$. The addition of a small amount of boron, here three percent of the total composition was found to improve the intrinsic coercivity of praseodymium-iron compounds from roughly 6.0 to over 16 kOe at quench velocities of about 7.5 meters per second. While I have extensively examined neodymium-iron systems, other rare earth and transition metal alloys containing boron and processed in accordance with the subject invention will exhibit permanent magnetic properties as will be described by example hereinafter.

EXAMPLE 10

FIGS. 11 and 12 show the properties of $Nd_{1-x}(Fe_{0.95}B_{0.05})_x$ alloys. The samples were ejected from the 675 micron capillary onto a quench wheel moving at the near optimum speed of $V_s$=15 m/s. FIG. 11 shows the energy product (BH), the magnetic remance $B_r$ and the inductive coercivity $H_c$ for the several neodymium contents. The remanence, coercivity and magnetic energy product all peak at an X (the total atomic fraction of Fe and B) approximately equal to 0.86. An energy product of 14.1 MG.Oe was achieved which is nearly commensurate with the energy product of oriented samarium-cobalt magnets. FIG. 12 shows intrinsic coercivity $H_{ci}$. Maximum $H_{ci}$ was achieved at about X=0.75.

FIG. 13 is a scanning electron micrograph of the transverse fracture surface of a ribbon sample of the 14.1 megaGauss Oersted direct quenched alloy. The micrographs were taken near the quench surface, i.e., that surface which impinges the quench wheel in the melt-spinning process; at the center of the ribbon cross section; and at the free surface, i.e. that surface farthest from the quench wheel.

It has been found that those magnetic materials exhibiting substantially uniform crystallite size across the thickness of the ribbon tend to exhibit better permanent magnetic properties than those showing substantial variation in crystallite size throughout the ribbon thickness. The directly quenched material of FIG. 13 appears to consist of fine crystallites which range in size from approximately 20 to 50 nanometers. This crystallite size is probably close optimum single magnetic domain size.

FIG. 14 shows the demagnetization behavior for the 14.1 megaGauss Oersted directly quenched magnet material. The relatively high remanence of about 8.2 kG contributes substantially to the high energy product (B×H).

EXAMPLE 11

FIG. 15 shows the effect of varying the neodymium content $Nd_{1-x}(Fe_{0.95}B_{0.05})_x$ alloys on the second quadrant demagnetization curve. The samples were ejected from the 675 micron capillary at a near optimum quench wheel speed of $V_s$=15 m/s. For neodymium contents of less than about 10 percent, the inductive coercivity H is less than about 7 kiloOersteds. The highest remanence is achieved for neodymium contents of approximately 15 to 13.4 atomic percent. Higher neodymium contents, X=0.8 and X=0.75 have a tendency to reduce the magnetic remanence but increase the intrinsic coercivity of directly quenched alloy. From this information, it has been hypothesized that the near optimum composition for neodymium-iron-boron alloys contain approximately 14 percent neodymium. However, there may be substantial latitude in these compositions depending on what one desires to achieve in ultimate magnetic properties. Moreover, certain amounts of other rare earth metals may be substituted for neodymium which will be described hereinafter.

EXAMPLE 12

FIG. 16 shows demagnetization curves for melt-spun $Nd_{0.33}(Fe_{0.95}B_{0.05})_{0.67}$ as a function of temperature. The samples were remagnetized in the pulsed 45 kOe field between temperature changes. Elevated temperatures have some adverse effect on the remanent magnetization of these materials. Experimental evidence indicates that approxiately 40 percent of the $H_{ci}$ may be lost between temperatures of 400° and 500° C. This is generally comparable to the losses experienced by mischmetal-samarium-cobalt, and $SmCo_5$ magnets at like temperatures. Given the high initial $H_{ci}$ of my alloys, however, in many applications such losses may be tolerated.

EXAMPLE 13

Figure 10:
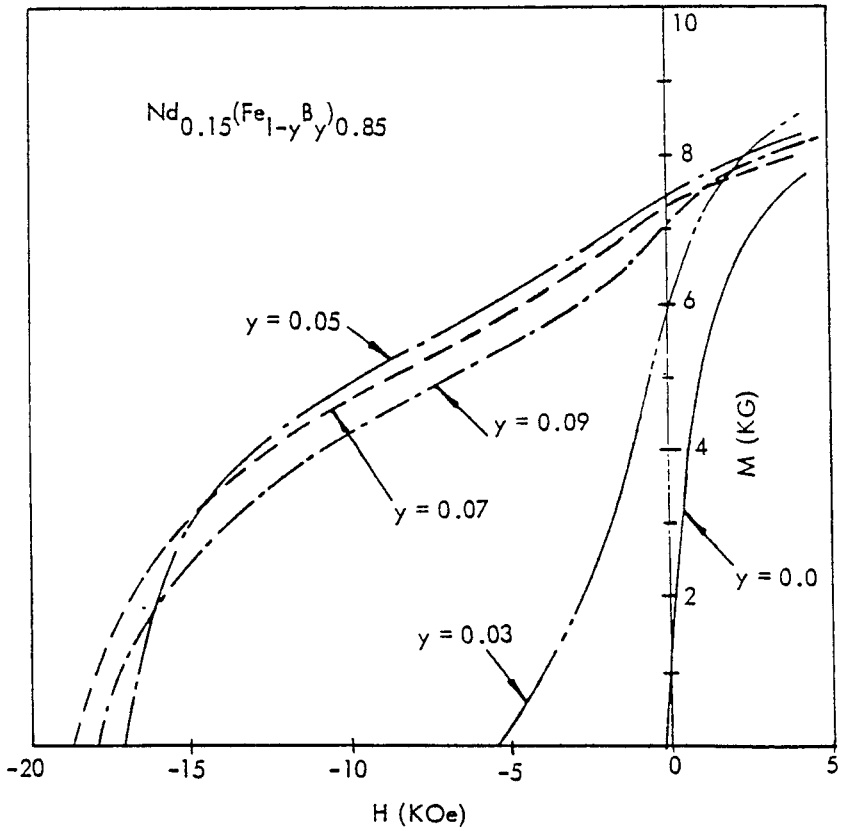
FIG. 10 shows demagnetization curves for melt spun $Nd_{0.15}(Fe_{1-y}B_y)_{0.85}$ alloys.

FIG. 17 shows demagnetization curves for melt-spun $Nd_{0.15}(Fe_{0.95}B_{0.05})_{0.85}$ as a function of temperature. When compared to FIG. 10, it is clear that higher atomic percentages of iron tend to improve the magnetic remanence and, hence, energy product of the subject alloys at elevated temperatures

EXAMPLE 14

FIG. 18 shows a normalized plot of the log of intrinsic coercivity as a function of temperature for three different neodymium-iron-boron alloys. In the higher iron content alloy, intrinsic coercivity decreases less rapidly as a function of temperature than in the higher neodymium fraction containing compounds.

EXAMPLE 15

FIG. 19 shows the value of magnetic remanence as a function of temperature in degrees Kelvin for $Nd_{1-x}(Fe_{0.95}B_{0.05})_x$ alloys where X=0.85, 0.80, 0.67 and for $Nd_{0.4}(Fe_{0.97}B_{0.03})_{0.6}$. Again, the higher iron content alloys show higher remanence at elevated temperatures.

EXAMPLE 16

FIG. 20 shows magnetization dependence of melt spun $Nd_{0.25}(Fe_{1-y}B_y)_{0.75}$ on temperature. The higher boron content alloys showed a dip in the magnetization curve at temperatures between about 100 and 300° Kelvin. The reason for this apparent anomaly is not currently understood. The Curie temperature ($T_c$) was substantially elevated by the addition of boron: Tc=453° K for no boron and 533° K with 3.75 atomic percent boron (Y=0.05). FIG. 20 shows the effect of adding boron on Curie temperature for several neodymium-iron-boron alloys.

EXAMPLE 17

FIG. 21 shows the effect of varying the amount of neodymium in a neodymium-iron-boron alloy on magnetization of melt-spun samples at temperatures between 0 and 600° K. The dip between 100 and 300° Kelvin is noted in all of the curves although the high iron content alloy magnetization curve is substantially flatter in that temperasture range than the higher neodymium content alloys.

EXAMPLE 18

FIG. 22 shows x-ray spectra (CuK alpha) of $Nd_{0.15}(Fe_{1-y}B_y)_{0.85}$, Y=0.00, 0.03, 0.05, 0.07, 0.09 alloy samples ejected from 675 micron orifice onto a quench wheel moving at $V_s$=15 m/s. The selected samples exhibited maximum intrinsic coercivity for each boron level. The data X-ray were taken from finely powdered specimens over a period of several hours. The x-ray intensity units are on an arbitrary scale.

The boron-free alloy X-ray spectra include Bragg reflections corresponding to the neodymium and $Nd_2Fe_{17}$ phases, neither of which is believed to account for even a limited amount of coercivity in these alloys since the highest Curie temperature of either ($Nd_2Fe_{17}$) is only 331° K. X-ray data indicate that the inclusion of boron in $[Nd_{0.15}(Fe_{1-y}B_y)_{0.85}]$, where $0.03 \lesssim y \lesssim 0.05$, stabilizes a Nd-Fe-B intermetallic phase. This phase is believed to be responsible for the permanent magnetic properties. Its Curie temperature is well above that of any other known Nd-Fe compounds.

EXAMPLE 19

FIG. 23 compares the x-ray spectra of the quenched surface of an $Nd_{0.25}(Fe_{0.95}B_{0.05})_{0.75}$ alloy ribbon to the free surface. The quenched surface is defined as that surface of the ribbon which impinges on the cooling substrate. The free surface is the opposite flat side of the ribbon which does not contact the cooling substrate. Clearly, the free surface sample shows more crystallinity than the quenched surface. This may be explained by the fact that the free surface cools relatively slower than the quenched surface allowing more time for crystallographic ordering of the elements.

EXAMPLE 20

FIG. 24 displays differential scanning calorimetry data for optimum directly quenched $Nd_{0.25}(Fe_{1-y}B_y)_{0.75}$ which alloys exhibit maximum coercivity FIG. 2. The data were taken at a heating rate of 80° K per minute. The addition of boron clearly increases the crystalline character and reduces the amorphous or glass-like characteristics of these optimum melt spun alloys. This was not expected as boron is known to promote glass formation in some other compositions, e.g. ($Fe_8B_2$). The Y=0.05 alloys appear to have a particularly crystalline nature as indicated by the absence of any increased apparent specific heat (ASH) release up to 1000° K. The sharp elevation in ASH at 940° K is believed to be associated with partial melting of the alloy.

EXAMPLE 21

FIG. 25 displays differential scanning calorimetry data for $Nd_{0.15}(Fe_{1-y}B_y)_{0.85}$ alloys (y=0.0, 0.05 and 0.09) quenched at $V_s$=15 m/s and 30 m/s. X-ray data for the 15 m/s alloys are shown in FIG. 16. The DSC tracings of all of the $V_s$=15 m/s alloys, which are close to the optimum quench, are relatively flat, confirming the predominantly crystalline charater indicated by the X-ray data. In contrast, all of the $V_s$=30 m/s alloys for y=0.05 and 0.09 exhibit large increased in apparent specific heat in the vicinity of 850°-900° K, indicating that randomly arranged atoms in the alloys undergo crystallization in the temperature range. X-ray patterns of the alloy before heating also indicate glass-like or amorphous behavior, exhibiting a single broad peak centered at 2020 -40°.

In contrast, the DSC and X-ray data for the y=0.0 (boron-free) alloy was little changed between $V_s=15$ and 30 m/s. Moreover, no large increase in apparent specific heat occurred above 900° K. Boron is necessary to achieve a microstructure in an overquenched alloy which can be later annealed to a magnetically hard state. Without boron, one cannot anneal an overquenched alloy to a magnetically hard state. This is because the Nd-Fe-B phase is not present.

EXAMPLE 22

FIG. 26 shows typical demagnetization curves for various permanent magnet materials and lists values for their maximum energy products. Clearly, only $SmCo_5$ shows slightly better room temperature magnetic properties than the subject neodymium-iron-boron compositions. Bonded $SmCo_5$ powder magnets are substantially weaker. It is believed that the subject RE-TM-B compositions could be used in high quality, high coercivity, hard magnet applications at substantially less cost than oriented $SmCo_5$ magnets both because of the lower cost of the constituent elements and easier processing. The subject hard magnet compositions have much better properties than conventional manganese-aluminum-carbon, Alnico, and ferrite magnets.

EXAMPLE 23

FIG. 27 shows that adding boron to $ND_{1-x}(Fe_{1-y}B_y)_x$ alloys substantially elevates the alloys' apparent Curie temperatures. So far as practical application of the subject invention is concerned, increased Curie temperature greatly expands the possible uses for these improved hard magnet materials. For example, magnets with Curie temperatures above about 500° K (237° C.) could be used in automotive underhood applications where temperatures of 150° C. may be encountered.

The data points which are blacked-in in FIG. 27 particularly show the substantial increase in Curie temperature provided by adding 5 percent boron based on the iron content of the neodymium-iron melt spun alloys having less than 40 atomic percent neodymium. Like alloys without boron added to them showed a marked tendency to lowered apparent Curie temperature in alloys containing less than 40 atomic percent neodymium. That is, including boron not only elevates Curie temperature but does so at relatively lower rare earth concentrations. Thus, adding boron to suitable substantially amorphous RE-TM alloys increases intrinsic magnetic coercivity and Curie temperature at relatively high iron concentrations. These results are very desirable.

EXAMPLE 24

Experiments were conducted on iron-rich alloys to determine whether comparable hard magnet characteristics could be induced in the subject RE-TM-B compositions by annealing magnetically soft substantially amorphous forms of the alloy. Referring to FIG. 28, a representative alloy of $Nd_{0.15}(Fe_{0.95}B_{0.05})_{0.85}$ was melt-spun onto a chill disc having a surface velocity $V_2$ of 30 meters per second. The ribbon so produced was amorphous and had soft magnet characteristics indicated by the sharp slope of its demagnetization curve (no anneal, $V_s=30$ m/s, line in FIG. 28). When this ribbon was annealed at about 850° K for about 15 minutes the maximum magnetic coercivity increased to about 10.5 kOe and the alloy exhibited hard magnetic characteristics.

When a like Nd-Fe-B alloy was melt-spun and quenched in like manner on a chill disc having a surface velocity of $V_2=15$ meters per second, an amorphous to finely crystalline alloy was produced with an intrinsic room temperature coercivity of about 17 kOe (no anneal, $V_s=15$ m/s, line in FIG. 28), much higher than that of the alloy quenched at $V_s=30$ either before or after annealing. When the alloy melt spun at $V_2=15$ meters per second was annealed at about 850° K, its intrinsic coercivity dropped to levels nearly matching those of the annealed $V_s=30$ samples.

EXAMPLE 25

An alloy of $Nd_{0.14}(Fe_{0.95}B_{0.05})_{0.86}$ was prepared by ejecting a 25 gram sample of molten alloy from a quartz crucible onto the perimeter of a chromium plated copper disc rotating at a speed $V_s=30$ meters per second. The orifice size was approximately 670 micron meters and the-ejection pressure was approximately 3.0 psi argon. This produced overquenched alloys with virtually no hard magnetic properties. The line marked "no anneal" on FIG. 29 shows the coercivity and remanence of the alloy as melt spun.

The melt spun ribbon was coarsely crushed and samples weighing approximately 60 milligrams each were weighed out. The subsequent heating or annealing regimen was carried out under one atmosphere of flowing argon in a Perkin-Elmer (DSC-ii) differential scanning calimeter. The calorimeter was initially at room temperature with he temperature being raised at a rate of 160° K per minute up to a peak temperature of 950° K. The samples were cooled to room temperature at the same rate. The demagnetization data were taken on a magnetometer after first magnetizing the samples in the pulsed field of about 40 kiloGauss.

FIG. 29 shows second quadrant demagnetization curves for the samples as a function of how long they were maintained at the peak anneal temperature of 950° K. The line marked 0 min. represents the magnetic characteristics of a sample elevated to 950° K at the ramp rate of 160° K per minute and then immediately cooled to room temperature at the same rate of 160° K per minute. The curves for 5, 10 and 30 minutes refer to maintaining the samples at the 950° K peak temperature for periods of 5, 10 and 30 minutes at heating and cooling ramp rates of 160° K per minute.

It is clear from this data that holding a sample at an elevated temperature of 950° K for any substantial period of time adversely affects the magnetic strength of the annealed alloy. As the best magnetic properties were obtained for the samples which were rapidly annealed and then rapidly cooled, it appears that the speed of the annealing process is significant to the formation of the desired hard magnetic properties in the alloys. While a rapid convection heating is effective in creating the permanent magnetic phase in the rare earth-iron-boron alloys, other processes such as mechanically working or hot pressing overquenched alloys could also promote the formation of the very finely crystalline permanent magnetic phase.

EXAMPLE 26

A $Nd_{0.14}(Fe_{0.95}B_{0.05})_{0.86}$ alloy was melt spun at quench wheel speeds $V_s=27.5$ and 30 m/s. The samples were annealed in a differential scanning calorimeter at heating and cooling ramp rates of 40 and 160° K per minute. The alloy quenched at $V_s=27.5$ m/s exhibited higher remanence than the $V_s=30.0$ m/s alloy. For both values of $V_s$, the sample annealed at the higher ramp rate of 160° K per minute showed higher second quadrant remanence and coercivity than those annealed at the 40° K per minute ramp rate. Thus, rapid heating and low time at maximum temperature appear to promote formation of crystallites in the desired size range between about 20 and 200 nanometers. Over-annealing probably causes excess crystal growth and the creation of larger than optimum single domain sized particles. Excessive crystal growth, such as that brought about by extended anneal (see FIG. 29, e.g.) tends to degrade magnetic strength.

EXAMPLE 27

FIG. 31 shows a plot of maximum energy product for $Nd_{0.14}(Fe_{0.95}B_{0.05})_{0.86}$ alloy. The circular open data points represent energy products for alloy directly quenched at the quench wheel speeds $V_s$ indicated on the X axis. The other data points represent the maximum energy product for alloy quenched at the $V_s$ indicated on the X-axis and then annealed in a differential scanning calorimeter at a heating and cooling ramp rate of 160° K per minute to maximum temperatures of 1000, 975 and 950° K.

A maximum energy product of 14.1 megaGauss Oersted was reached for the alloy directly quenched at an approximate wheel speed of 19 m/s. The alloy directly quenched at wheel speeds greater than about 20.5 meters per second shows rapidly decreasing energy product with quench wheel speed. At about $V_s=30$ meters per second, the alloy as quenched has substantially no energy product. The solid round, triangular and square data points represent the measured maximum energy products for the alloy quenched at the corresponding $V_s$ on the X axis after they have been annealed to maximum temperatures of 1000, 975 and 950° K, respectively. The annealing steps were conducted in a differential scanning calorimeter at a heating and cooling ramp rate of 160° K per minute. It is evident from FIG. 31, that the alloy can be overquenched and then annealed back to produce a form of the alloy with high magnetic energy product. This is a strong support for the hypothesis that the phase responsible for the permanent magnetic properties in the alloy is finely crystalline and is probably commensurate with optimum single domain size. The overquenched alloy, i.e., in this case those melt spun ribbons quenched at a wheel speed greater than about 20 meters per second would either be completely amorphous or have crystallites or particle sizes in their microstructures smaller than optimum single magnetic domain size. The heating step is believed to promote the growth of the crystallites or particles within the microstructure to achieve the near optimum single domain size. Surprisingly, the size of the crystallites after a rapid heating to 950° K is fairly uniform throughout the ribbon thickness.

FIG. 32 shows the second quadrant magnetization curves for the alloy of FIG. 31 as directly quenched at the indicated wheel speeds. FIG. 33 shows X-ray diffraction patterns for these alloys as they come off the quench wheel at the indicated wheel speeds. It is apparent from these X-ray spectra that increasing the wheel speed decreases the occurrence of specific peaks and creates a much more amorphous looking pattern. The patterns for $V_s=35$ and 40 m/s are characteristic of an amorphous, glassy substance. Annealing any of the alloys in accordance with the regiment described with respect to FIG. 31 creates an X-ray diffraction pattern similar to that for $V_s=19$ m/s of FIG. 33. However, much better magnetic properties are observed for suitably annealed samples which initially show some incipient crystallization like $V_s=27.5$ m/s in FIG. 33. Annealing amorphous alloy with a glassy X-ray pattern (e.g. $V_s=35$ and 40 m/s in FIG. 33) creates permanent magnetic properties but the remanence is lower.

A comparison was made between the second quadrant magnetic characteristics of the $Nd_{0.14}(Fe_{0.95}B_{0.05})_{0.86}$ alloy originally quenched at wheel speeds of 20.5 m/s (FIG. 35) to alloy quench at wheel speeds of 35 m/s (FIG. 36). The slightly overquenched material ($V_s=20.5$ m/s) showed magnetic remanence over 8 kiloGauss and coercivity over 12 kiloOersteds and a maximum energy product of 13.7 megaGauss Oersted. On the other hand, the grossly overquenched alloy ($V_s=35$ m/s) showed maximum magnetic remanence below 8 megaGauss Oersted. The maximum energy product for the greatly overquenched $V_s=35$ m/s alloy was 11.9 megaGauss Oersted.

FIG. 34 shows differential scanning calorimeter traces for the alloys of FIG. 31 quenched at wheel speed $V_s=19$, 20.5 and 35 m/s. That quenched at 19 meters per second representing the optimum direct quenched alloy shows a decrease in apparent specific heat (ASH) at about 575° K and then a slight increase in ASH up to the maximum operating temperature available of the DSC (~1000° K). The alloy that was overquenched slightly at a $V_s=20.5$ m/s also showed a decrease in ASH at 575° K but it also exhibits a sustantial increase in ASH at about 875° K. It has been theorized that this peak at 875° K is associated with crystallization and growth of the magnetic phase in the alloy. The substantially amorphous, grossly overquenched alloy melt spun at $V_s=35$ m/s does not exhibit a decrease in ASH at 575° K but shows an even larger increase in ASH at about 875° K.

In this and other examples, $RE_{1-x}(Fe_{1-y}B_y)_x$ where $0.88 \lesssim x \lesssim 0.86$ and $0.05 \lesssim y \lesssim 0.07$ believed to be the nominal composition of the phase primarily responsible for the hard magnetic properties. The preferred RE elements are neodymium and praseodymium which are virtually interchangeable with one another. The phase, however, is relatively insensitive to the substitution of as much as 40 percent of other rare earth elements for Pr and Nd without its destruction. In the same vein, substantial amounts of other transition metals can be substituted for iron without destroying the phase. This phase is believed to be present in all compositions of suitable microstructure having hard magnetic properties. Varying the amounts of the constituents, however, changes the amount of the magnetic phase present and consequently the magnetic properties, particularly remanence.

FIG. 37 is a scanning electron micrograph of the fracture surface of an overquenched ($V_s=30$ m/s) $Nd_{0.14}(Fe_{0.95}B_{0.05})_{0.86}$ ribbon showing the microstructure, near the free surface, the middle and the quench surface. The slower cooling free surface shows a very slight degree of crystallization which shows up on the micrograph as a speckled appearance. The dot in the middle frame of the Figure is an extraneous, nonsignificant SEM feature. The middle and quench surfaces of the ribbon appear to be substantially amorphous, that is, discrete crystallites are not obviously distinguishable.

FIG. 38 is an SEM of the fracture surface of the overquenched ($V_s$=30 m/s) $Nd_{0.14}(Fe_{0.95}B_{0.05})_{0.86}$ alloy after a DSC anneal to a maximum temperature of 950° K at a heating and cooling ramp rate of 160° K per minute. It is clear from this SEM that fairly regularly shaped crystallites or particles have formed in the ribbon as a result of the annealing step. These crystallites have an average size between 20 and 400 nanometers but are not as uniformly sized throughout the thickness of the ribbon as the crystallites of the 14.1 MG.Oe directly quenched alloy. A uniform crystallite size seems to be characteristic of the highest energy product alloys. The measured preferred size range for these crystallites is in the range from about 20 to 400 nanometers, preferably about 40–50 nanometers average.

FIG. 39 shows the second quadrant magnetization curves for optimally directly quenched alloys of this example compared with the overquenched and annealed $V_s$=20.5 and 35 m/s samples.

EXAMPLE 28

FIG. 11 is a plot of magnetic remanence of $Nd_{0.15}(Fe_{1-y}B_y)0.85$ for boron-free and y=0.03, 0.05, 0.07, 0.09 alloys. The samples were cast from an orifice approximately 675 microns in size at a quench rate of approximately 27.5 meters per second. As will be described hereinafter, the samples were heated to a peak temperature of approximately 975° K in a differential scanning calorimeter at a heating and cooling ramp rate of approximately 160° K per minute. The boron-free alloy y=0.0 showed substantially no coercivity after anneal and magnetization. That containing 0.03 boron exhibited a coercivity of approximately 6 kiloOersteds. At a boron content of 0.05 both magnetic remanence and coercivity were substantially increased to approximately 17.5 kiloOersted and 7.5 kiloGauss, respectively. At a boron content of 0.07, the coercivity increased while the magnetic remanence droped slightly. At a boron content of 0.09, both remanence and coercivity dropped with respect to the 0.07 boron content.

EXAMPLE 29

FIG. 40 is a demagnetization plot for $Pr_{0.135}(Fe_{0.935}B_{0.065})_{0.865}$ alloy that was melt spun through a 675 micron orifice onto a quench wheel moving at $V_s$=30 m/s. The resultant alloy ribbon was overquenched and had substantially no magnetic coercivity. Samples of the ribbon were annealed in a differential scanning calorimeter at a heating and cooling ramp rate of 160° K per minute to maximum peak temperatures of 900, 925 and 975° K. The alloy heated to the 900° K maximum temperature had the highest magnetic remanence. Increasing the peak anneal temperature tended to reduce the remanence slightly but very much increased the coercivity.

Clearly, praseodymium is also useful as the primary rare earth constituent of rare earth-iron-boron hard magnetic phase. It also appears to be evident that control of the time and temperature of annealing overquenched originally not permanently magnetic alloy can be controlled in such manner as to tailor the permanent magnetic properties. It seems that a rapid higher temperature anneal while reducing the remanence somewhat can be used to achieve very high magnetic coercivities. On the other hand, using lower temperature rapid anneals may tend to maximize the energy product by increasing the magnetic remanence still at coercivities greater than 15 kiloOersted.

EXAMPLE 30

FIG. 41 shows demagnetization curves for $RE_{0.135}(Fe_{0.935}B_{0.065})_{0.865}$ alloy where RE is praseodymium, neodymium, samarium, lanthanum, cerium, terbium or dysprosium. In each alloy, only a single rare earth was used, i.e., the rare earths were not blended with one another to form an alloy sample. Each alloy sample was melt spun through an ejection orifice approximately 675 microns in size onto a quench wheel rotating at $V_s$=30 m/s. Each of the alloys as formed had less than one kiloOersted coercivity and was overquenched. The alloy samples were annealed in the differential scanning calorimeter at heating and cooling ramp rates of 160° K per minute to a maximum temperature of 950° K.

Praseodymium and neodymium were the only sole rare earth elements of those tried which created annealed alloys with high coercivity remanence and energy products. Samarium and lanthanum showed very slight coercivities coupled with fairly steep remanence curves. The cerium showed some coercivity and remanence. Terbium exhibited low coercivity and very low remanence. While none but the pure praseodymium and neodymium alloys showed characteristics suitable for making very strong permanent magnets, the hysteresis characteristics of the other rare earths may provide magnetic materials which could be very useful for soft magnetic or other magnetic applications.

EXAMPLE 31

FIG. 42 shows the effect of substituting 20 percent of a different rare earth based on the amount of neodymium and such rare earth in $Nd_{0.8}RE_{0.2})_{0.135}(Fe_{0.935}B_{0.065})_{0.865}$ alloys. Each of these 80 percent neodymium and 20 percent other rare earth alloys was melt spun and processed as in Example 31. The substitution of 20 percent dysprosium, praseodymium and lanthanum created alloys with good permanent magnetic properties. The terbium containing alloy had a coercivity higher than could be measured by the magnetometer. The samarium containing alloy exhibited a remanence over 8 kiloGauss and a coercivity of about 6 kiloOersted. Table 1 shows the compositions, intrinsic coercivities, magnetic remanence and energy product for the alloys shown in Examples 31 and 32.

TABLE I

| Composition | $H_{ci}$(kOe) | $B_r$(kG) | $(BH)_{max}$ |
|---|---|---|---|
| $La_{0.135}(Fe_{0.935}B_{0.065})_{0.865}$ | 0 | 0 | 0 |
| $(Nd_{0.8}La_{0.2})_{0.135}(Fe_{0.935}B_{0.065})_{0.865}$ | 11.6 | 7.8 | 12.1 |
| $Ce_{0.135}(Fe_{0.935}B_{0.065})_{0.865}$ | 2.2 | 3.4 | 1.3 |
| $(Nd_{0.8}Ce_{0.2})_{0.135}(Fe_{0.935}B_{0.065})_{0.865}$ | 13.0 | 7.5 | 11.0 |
| $(Nd_{0.95}Ce_{0.05})_{0.135}(Fe_{0.935}B_{0.065})_{0.865}$ | 12.3 | 7.8 | 11.2 |
| $Pr_{0.135}(Fe_{0.935}B_{0.065})_{0.865}$ | 16.8 | 7.7 | 12.4 |
| $(Nd_{.8}Pr_{.2})_{0.135}Fe_{0.935}B_{0.065})_{0.865}$ | 15.7 | 7.7 | 11.9 |
| $Sm_{0.135}(Fe_{0.935}B_{0.065})_{0.865}$ | 1.8 | 6.0 | 2.6 |
| $(Nd_{.8}Sm_{.2})_{0.135}(Fe_{0.935}B_{0.065})_{0.865}$ | 5.7 | 8.3 | 9.82 |
| $Tb_{0.135}(Fe_{0.935}B_{0.065})_{0.865}$ | 1.2 | 0.3 | 0.1 |
| $(Nd_{.8}Tb_{.2})_{0.135}(Fe_{0.935}B_{0.065})_{0.865}$ | >20 | 6.7 | 9.8 |
| $(Nd_{.95}Tb_{0.05})_{0.135}(Fe_{0.935}B_{0.065})_{0.865}$ | 15.8 | 7.7 | 11.6 |
| $Dy_{0.135}(Fe_{0.935}B_{0.065})_{0.865}$ | 1.5 | 0.3 | 0.1 |
| $(Nd_{.8}Dy_{.2})_{0.135}(Fe_{0.935}B_{0.065})_{0.865}$ | 18.3 | 6.8 | 9.90 |

It is clear from this data that substantial amounts of rare earth elements other than neodymium and praseodymium can be incorporated in rare earth-iron-boron alloys to create very finely crystalline permanent magnetic alloys. Neodymium and praseodymium metals can be mixed in suitable proportions with other rare earth elements to tailor the second quadrant magnetic characteristics for a particular application. For example, if a very high coercivity permanent magnet were desired terbium could be added to the composition. On the other hand, if magnetic remanence were the desired characteristic, it may be advantageous to add samarium.

EXAMPLE 32

FIG. 43 shows the demagnetization curves for $Nd_{0.135}(TM_{0.935}B_{0.065})_{0.865}$ where TM are the transition metals iron, cobalt and nickel. In this Figure, the transition metals were not mixed with one another to form the alloy. The alloys were melt spun and processed as in Example 30.

Of the transition metal elements, only iron yields an alloy with very good permanent magnetic properties. The cobalt shows moderate intrinsic coercivities and remanence, while the nickel containing alloy shows high coercivity but practically no magnetic remanence.

FIG. 44 shows the effect of adding 10 percent transition metal based on the amount of iron in the alloy to alloys of $Nd_{0.135}(Fe_{0.841}TM_{0.094}B_{0.065})_{0.865}$. FIG. 45 shows like curves for the addition of 20 percent based on the atomic percent of iron for alloys of $Nd_{0.135}(Fe_{0.748}TM_{0.187}B_{0.065})_{0.86}$. These alloys were also processed as in Example 31.

The substitution of 20 percent cobalt for iron in the alloys does not seem to have any deleterious affect, although 100 percent cobalt containing alloy does not exhibit very high remanence and coercivity. The incorporation of nickel, chromium and manganese seem to substantially dilute the hard magnetic properties of the pure iron alloy. The addition of copper radically lowers the coercivity and somewhat lowers the magnetic remanence. At alloy addition levels of 20 percent based on the iron content, nickel and chromium very much reduced the coercivity and the remanence as compared to the all iron alloys. Manganese produces an alloy with no second quadrant coercivity or remanence.

Table II shows the intrinsic coercivity, magnetic remanence and energy product for neodymium transition metal boron alloys The reported values are for the best overall combination of coercivity remanence and energy product where the aim is to produce a permanent magnet. Generally, such data represent the squarest shaped second quadrant demagnetization curve.

TABLE II

| Composition | $H_{ci}$(kOe) | $B_r$(kG) | $(BH)_{max}$ |
|---|---|---|---|
| $Nd_{0.135}(Fe_{0.748}Cr_{0.187}B_{0.065})_{0.865}$ | 3.7 | 3.0 | 1.0 |
| $Nd_{0.135}(Fe_{0.841}Cr_{0.094}B_{0.065})_{0.865}$ | 12.0 | 5.1 | 5.42 |
| $Nd_{0.135}(Fe_{0.888}Cr_{0.047}B_{0.065})_{0.865}$ | 15.1 | 6.4 | 8.25 |
| $Nd_{0.135}(Fe_{0.912}Cr_{0.023}B_{0.065})_{0.865}$ | 13.4 | 7.4 | 11.4 |
| $Nd_{0.135}(Fe_{0.748}Mn_{0.187}B_{0.065})_{0.865}$ | 0 | 0 | 0 |
| $Nd_{0.135}(Fe_{0.841}Mn_{0.094}B_{0.065})_{0.865}$ | 9.0 | 4.5 | 4.1 |
| $Nd_{0.135}(Co_{0.935}B_{0.065})_{0.865}$ | 1.3 | 3.0 | 0.6 |
| $Nd_{0.135}(Fe_{0.748}Co_{0.187}B_{0.065})_{0.865}$ | 14.5 | 7.90 | 12.9 |
| $Nd_{0.135}(Fe_{0.841}Co_{0.094}B_{0.065})_{0.865}$ | 13.7 | 7.95 | 12.7 |
| $Nd_{0.135}(Ni_{0.935}B_{0.065})_{0.865}$ | 15 | 0.15 | 0.1 |
| $Nd_{0.135}(Fe_{0.748}Ni_{0.187}B_{0.065})_{0.865}$ | 4.7 | 5.2 | 4.0 |
| $Nd_{0.135}(Fe_{.841}Ni_{0.94}B_{0.065})_{0.865}$ | 11.7 | 7.2 | 10.2 |
| $Nd_{0.135}(Fe_{0.912}Ni_{0.023}B_{0.065})_{0.865}$ | 13.0 | 7.8 | 12.0 |

It appears from these data that cobalt is interchangeable with iron at levels up to about 40 percent in the subject alloys. Chromium, manganese and nickel degrade the hard magnetic properties of the alloys.

Small amounts of the elements zironium and titanium were added to neodymium-iron-boron alloys, as set forth in Table III. The alloy compositions were melt spun and processed as in Example 31. The inclusion of small amounts (about 1½ atomic percent) of these elements still produced good hard magnetic alloys. The addition of zirconium had a tendency to substantially increase the intrinsic magnetic coercivity of the base alloy.

TABLE III

| Composition | $H_{ci}$(kOe) | $B_r$(kG) | $(BH)_{max}$ |
|---|---|---|---|
| $Nd_{0.135}(Fe_{0.916}Zr_{0.019}B_{0.065})_{0.865}$ | 18.5 | 7.25 | 10.9 |
| $Nd_{0.135}(Fe_{0.916}Ti_{0.019}B_{0.065})_{0.865}$ | 16.5 | 7.25 | 10.3 |

EXAMPLE 33

Substitutions for boron in $Nd_{0.135}(Fe_{0.935}B_{0.065})_{0.865}$ alloys were made. The substitute elements included carbon, aluminum, silicon, phosphorus and germanium as set forth in Table IV. The alloys were melt spun and processed as in Example 31 above. For all but the carbon, there resultant alloys had no magnetic energy product. Only carbon showed a slight energy product of 0.9 megaGauss with low values of intrinsic coercivity and remanence.

TABLE IV

| Composition | $H_{ci}$(kOe) | $B_r$(kG) | $(BH)_{max}$ |
|---|---|---|---|
| $Nd_{0.135}(Fe_{0.935}C_{0.065})_{0.865}$ | .75 | 2.25 | .9 |
| $Nd_{0.135}(Fe_{0.935}Al_{0.065})_{0.865}$ | 0 | 0 | 0 |
| $Nd_{0.135}(Fe_{0.935}Si_{0.065})_{0.865}$ | 0 | 0 | 0 |
| $Nd_{0.135}(Fe_{0.935}P_{0.065})_{0.865}$ | 0 | 0 | 0 |
| $Nd_{0.135}(Fe_{0.935}Ge_{0.065})_{0.865}$ | .2 | 0.1 | 0 |

The preceding Examples set out preferred embodiments of the subject invention. The combined permanent magnetic properties of coercivity, remanence and energy product for the subject RE-Fe-B alloys are comparable to those heretofore achieved only with oriented $SmCo_5$ and $Sm_2Co_{17}$ magnets. Not only are Pr, Nd and Fe less expensive than samarium and cobalt, but the subject magnetic alloys are easier and less expensive to process into permanent magnets.

Compilation of data from the several Examples indicates that the compositional range over which a major phase with the exhibited magnetic properties forms is fairly wide. For $Re_{1-x}(Fe_{1-y}B_y)_x$ alloys, X is preferably in the range of from about 0.5 to 0.9 and y is in the range of from about 0.005 to 0.1. The balance of the alloys is preferably iron. Up to about 40 percent of the iron can be replaced with cobalt with no significant loss of magnetics. Neodymium and praseodymium appear to be fairly intechangeable as the principal rare earth constituent. Other rare earth elements such as samarium, lanthanum, cerium, terbium and dysprosium, probably in amounts up to about 40 percent of the total rare earth content, can be mixed with neodymium and praseodymium without destruction of the magnetic phase or substantial loss of permanent magnetism. Other rare earths can be added to purposefully modify the demagnetization curves.

In view of the experimental data, the near optimum Nd-Fe-B and Pr-Fe-B alloy the nominal composition for maximizing permanent magnetic properties has been determined to be approximately $RE_{0.135}(Fe_{0.935}B_{0.065})_{0.865}$ or expressed in terms of the three constituent elements, $RE_{0.135}Fe_{0.809}B_{0.056}$ The subject samples were prepared from commercially available constituents which do contain some residual contaminants such as oxides, etc. Should higher purity constituents be employed, the composition, specifically the Nd to combined Fe-B ratio, would likely change slightly. This is a stable phase with an apparent Curie temperature of about 560° K.

Furthermore, rapid solidification of the alloy is believed to create a condition wherein the individual crystallites or particles in the alloy microstructure are about the same size or smaller than optimum single magnetic domain size. The optimum magnetic domain size is believed to about 40–50 nanometers average diameter. Alloys having crystallites in the size range of about 20–400 nanometers exhibit permanent magnetic properties. Alloys having smaller crystallites (<20 nanometers) may be heated to promote crystallite growth to optimum magnetic domain size.

The paths by which optimum crystallite size alloy can be made are (1) direct quench from the melt by means of a controlled quench rate process such as melt spinning, or (2) overquench to a microstructure having smaller than optimum single domain size crystallites followed by a heating process to promote crystallite growth to near optimum single magnetic domain size.

The SEM data for the highest energy product direct quenched alloys indicate that the crystallites or particles within the microstructure have a fairly regular shape. Magnetic data suggests that the crystal structure of the Nd-Fe-B intermetallic phase has high symmetry such as cubic or tetragonal. Further evidence for this is the high ratio of remanent to saturation magnetization which is theoretically about ~0.7. For a cubic structure for a uniaxial crystal structure such as a hexagonal "c" axis, this ratio would be ~0.5. While the major phase is believed to be primarily responsible for the permanent magnetic properties, electron microprobe analysis and TEM data suggest the presence of a small amount of a second phase of unidentified composition which may also contribute.

The directly quenched and overquenched and annealed alloy ribbons appear to be magnetically isotropic as formed. This is evidenced by the fact that the ribbon can be magnetized and demagnetized to the same strength in any direction. However, if single optimum magnetic domain size powder particles or the crystallites themselves can be caused to orient along a crystallographically preferred magnetic axis, it is possible that highly magnetically anisotropic alloys having much higher magnetic energy products than are reported herein would result.

In summary, I have discovered new and exceptionally strong magnetic alloys based on the rare earth elements neodymium and praseodymium, the transition metal element iron and a small amount of the element boron. The inclusion of boron in the RE-Fe systems provides many apparent advantages including the stabilization of an equilibrium phase with high apparent Curie temperature, a higher allowable ratio of iron to the more expensive rare earth constituents, a broad quench rate over which the optimum finely crystalline microstructure magnetic phase forms, and an ability to anneal overquenched alloy to create the optimum finely crystalline microstructure. The crystalline phase which forms is also tolerant to the substitution of limited amounts of many other constituents. I have also discovered efficient and economical means of making the subject alloys in forms adapted for the production of a new breed of permanent magnets It is expected that these magnets will find application in many industrial environments.

While my invention has been described in terms of specific embodiments thereof, other forms may be readily adapted by one skilled in the art. Accordingly, the scope of my invention is to be limited only by the following claims.

The embodiments of the invention in which an exclusive property or privilege is claimed are defined as follows:

1. A method of making a composition having permanent magnet properties at room temperature comprising preparing a melt of a composition comprising, on an atomic percentage basis of the total composition, 0.5 to 10 percent boron, 10 to 50 percent of one or more rare earth elements where neodymium or praseodymium or a mixture thereof constitutes at least 60 percent of the total rare earth element content, and one or more transition metal elements taken from the group consisting of iron and mixtures of iron and cobalt where iron constitutes at least 60 percent of the total transition metal, such molten composition being susceptible to being rapidly cooled to solidification over a determinable and controllable range of cooling rates within which range a series of fine grained crystalline products are formed that respectively display (a) values of magnetic coercivity that continually increase toward a maximum value and decrease from such value as the cooling rate is increased, and (b) values of magnetic remanence that increase over at least a part of such range as the cooling rate is increased, and continually rapidly cooling portions of the melt by ejecting them onto a moving quench surface to form a fine grained crystalline product while controlling the cooling rate within said cooling range by a method comprising controlling the rate of movement of such surface such that the product has a desired combination of magnetic coercivity and remanence.

2. A method for making a composition having permanent magnet properties at room temperature in accordance with claim 1 where the melt is rapidly cooled by continually expressing a portion of the melt through an orifice onto a quench surface of a spinning wheel and the cooling rate is controlled by a method comprising controlling the velocity of the quench surface of the spinning wheel to form a fine grained product having an average crystal size in the range of 20 to 400 nm.

3. A method for making a composition having permanent magnet properties at room temperature in accordance with claim 1 where the melt composition comprises 10 to 20 atomic percent of one or more rare earth elements taken from the group consisting of neodymium and praseodymium.

4. A method for making a composition having permanent magnet properties at room temperature in accordance with claim 1 where the melt composition consists essentially of 0.5 to 7 atomic percent boron, 10 to 20 atomic percent of one or more rare earth elements taken from the group consisting of neodymium and/or praseodymium, and one or more transition metal elements taken from the group consisting of iron and mixtures of iron and cobalt where iron constitutes at least about 60 atomic percent of the total transition metal.

5. A method for making a composition having permanent magnet properties in accordance with any one of claims 1, 3 or 4 where the cooling rate is controlled within said cooling range to form a product having a fine grained crystalline microstructure of average grain size less than about 50 nanometers, said product being suitable for annealing to increase its magnetic remanence and coercivity.

6. A method of making a composition having permanent magnet properties at room temperature comprising preparing a melt of a composition comprising, on an atomic percentage basis of the total composition, 0.5 to 10 percent boron, 10 to 50 percent of one or more rare earth elements where neodymium or praseodymium or a mixture thereof constitutes at least 60 percent of the total rare earth element content, and one or more transition metal elements taken from the group consisting of iron and mixtures of iron and cobalt where iron constitutes at least 60 percent of the total transition metal, such molten composition being susceptible to being rapidly cooled to solidification over a determinable and controllable range of cooling rates within which range a series of fine grained crystalline products are formed that respectively display (a) values of magnetic coercivity that continually increase toward a maximum value and decrease from such value as the cooling rate is increased, and (b) values of magnetic remanence that increase over at least a part of such range as the cooling rate is increased, and continually rapidly cooling portions of the melt by ejecting them onto a moving quench surface to form a fine grained crystalline product while controlling the cooling rate within said cooling range by a method comprising controlling the rate of movement of such surface to form a product having a fine grained crystalline microstructure of average grain size less than about 50 nanometers, said product being suitable for annealing to increase its magnetic remanence and coercivity, and thereafter heating the product at a temperature to cause crystal growth for a period of no more than 30 minutes to form a product having an average grain size no greater than about 400 nanometers in largest dimension and thereafter rapidly cooling the product.

* * * * *